US011793387B2

(12) United States Patent
Callahan et al.

(10) Patent No.: US 11,793,387 B2
(45) Date of Patent: Oct. 24, 2023

(54) PORTABLE DISHWASHER

(71) Applicant: Heatworks Technologies, Inc., Sullivan's Island, SC (US)

(72) Inventors: Jeremiah M. Callahan, Sullivan's Island, SC (US); Michael J. Wieckowski, Charleston, SC (US)

(73) Assignee: OhmIQ, Inc., North Charleston, SC (US)

( * ) Notice: Subject to any disclaimer, the term of this patent is extended or adjusted under 35 U.S.C. 154(b) by 232 days.

(21) Appl. No.: 16/729,716

(22) Filed: Dec. 30, 2019

(65) Prior Publication Data

US 2020/0214530 A1 Jul. 9, 2020

Related U.S. Application Data

(60) Provisional application No. 62/787,979, filed on Jan. 3, 2019.

(51) Int. Cl.
*A47L 15/00* (2006.01)
*A47L 15/42* (2006.01)
(Continued)

(52) U.S. Cl.
CPC ..... *A47L 15/0089* (2013.01); *A47L 15/4223* (2013.01); *A47L 15/4225* (2013.01);
(Continued)

(58) Field of Classification Search
CPC ..... A47L 15/0089; A47L 15/4223; A47L 15/4225; A47L 15/4246; A47L 15/4285;
(Continued)

(56) References Cited

U.S. PATENT DOCUMENTS 298,015 A 5/1884 Garza
2,218,869 A 10/1940 Bilde et al.
(Continued)

FOREIGN PATENT DOCUMENTS

CH 711106 A2 * 11/2016 ..... A47L 15/0089
CH 711106 A2 11/2016
(Continued)

OTHER PUBLICATIONS

International Search Report including Written Opinion for Application No. PCT/US2019/068903, dated Jul. 29, 2020, pp. 1-21.
(Continued)

*Primary Examiner* — Michael E Barr
*Assistant Examiner* — Pallavi Chitta
(74) *Attorney, Agent, or Firm* — Lerner David LLP

(57) ABSTRACT

A dishwasher has a housing (10) with a wash chamber (20) and a top wall (204) with a non-planar surface (214;214") facing downwardly into the wash chamber, the surface having portions (216,218; 226,228) facing downwardly and facing in different horizontal directions (H1,H2; HX,HY,HP, HQ). Nozzles (402) mounted within the wash chamber spray a liquid upwardly within the wash chamber. The surface portions redistribute the upwardly-sprayed water in horizontal directions to provide a more uniform washing action. A portable dishwasher may have a fresh water reservoir (422) and a used water reservoir (430) mounted in the housing beneath the wash chamber. The used water reservoir may be removably mounted in the housing so that the user can remove used wash water by removing the used water reservoir. The portable dishwasher can be used at a location remote from a sink.

28 Claims, 6 Drawing Sheets

(51) Int. Cl.
*A47L 15/44* (2006.01)
*A47L 15/46* (2006.01)

(52) U.S. Cl.
CPC ..... *A47L 15/4246* (2013.01); *A47L 15/4285* (2013.01); *A47L 15/449* (2013.01); *A47L 15/4445* (2013.01); *A47L 15/4463* (2013.01); *A47L 15/46* (2013.01); *A47L 2401/09* (2013.01); *A47L 2501/01* (2013.01); *A47L 2501/02* (2013.01); *A47L 2501/03* (2013.01); *A47L 2501/05* (2013.01)

(58) Field of Classification Search
CPC ..... A47L 15/4445; A47L 15/4463; A47L 15/449; A47L 15/46; A47L 2401/09; A47L 2501/01; A47L 2501/02; A47L 2501/03; A47L 2501/05; A47L 15/4251; A47L 15/4219
See application file for complete search history.

(56) References Cited

U.S. PATENT DOCUMENTS 4,641,671 A * 2/1987 Nogi ..... A47L 15/4225 134/113
2008/0041419 A1 2/2008 Gaus
2011/0174346 A1* 7/2011 Kessler ..... A47L 15/4454 222/52
2014/0360530 A1 12/2014 Pers et al.

FOREIGN PATENT DOCUMENTS

| | | | | | |
|---|---|---|---|---|---|
| CN | 1833599 | A | | 9/2006 | |
| CN | 107212835 | A | * | 9/2017 | ..... A47L 15/0089 |
| CN | 108814511 | A | | 11/2018 | |
| DE | 4438295 | A1 | | 7/1996 | |
| DE | 102005008987 | B3 | | 6/2006 | |
| DE | 102012200227 | B4 | | 10/2016 | |
| EP | 0709055 | A1 | | 5/1996 | |
| JP | H06245890 | A | | 9/1994 | |
| WO | 2006056514 | A1 | | 6/2006 | |
| WO | 2008055035 | A1 | | 5/2008 | |
| WO | 2014061833 | A1 | | 4/2014 | |
| WO | WO-2018054808 | A1 | * | 3/2018 | ..... B61D 35/00 |

OTHER PUBLICATIONS

International Search Report with Written Opinion for Application No. PCT/US2019/068903, dated Jun. 25, 2020, 21 pages.
Partial International Search Report including Provisional Opinion for Application No. PCT/US2019/068903, dated Apr. 6, 2020, pp. 1-14.

* cited by examiner

FIG. 7
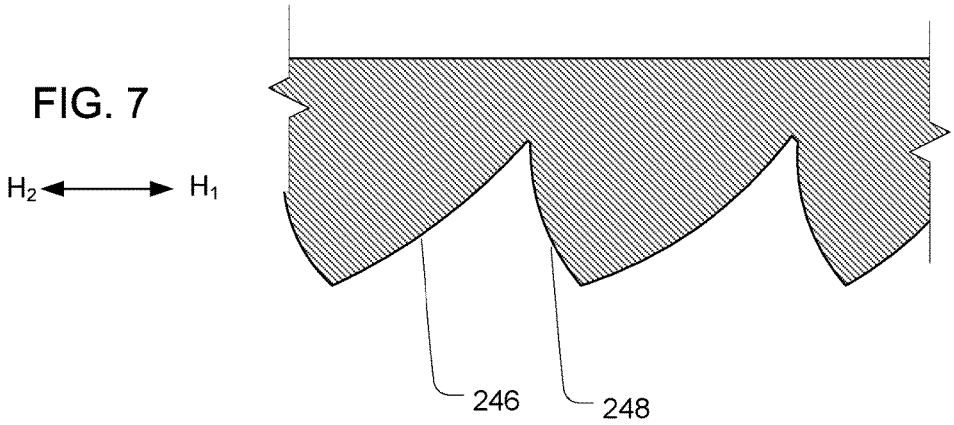
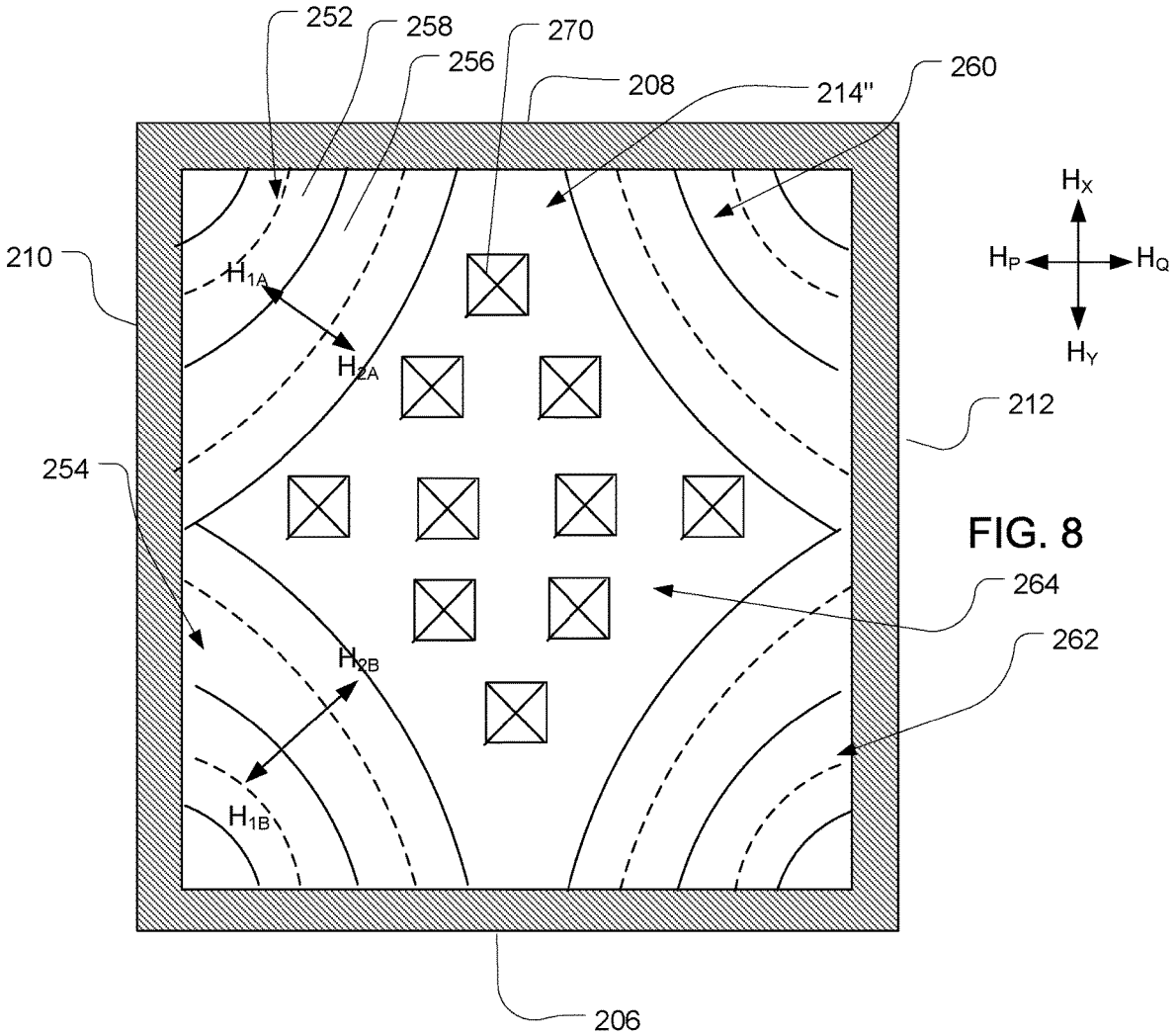
FIG. 8

PORTABLE DISHWASHER

CROSS-REFERENCE TO RELATED APPLICATIONS

This application claims the benefit of the filing date of U.S. Provisional Patent Application No. 62/787,979, filed Jan. 3, 2019, the disclosure of which is incorporated herein by reference.

BACKGROUND OF THE INVENTION

The present invention relates to dishwashers.

Traditional dishwashers used in homes are often bulky and must be coupled to the home's plumbing and drainage systems. Many people live in homes and apartments where it is impractical to install a traditional dishwasher due to lack of space, lack of the necessary plumbing provisions, or both. Likewise, it is generally impractical to install a traditional dishwasher in a vehicle such as a trailer, recreational vehicle or boat which is used as a temporary or permanent dwelling.

As shown, for example, in International Application Publication WO 2006/056514 and in German Offenlegungschrift DE 4438295, countertop dishwashers, also referred to herein as portable dishwashers, have been proposed. Portable dishwashers can be placed temporarily on a countertop or other surface, without the need for a permanent connection to a plumbing system. One aspect of the present invention provides further improvements in portable dishwashers.

Moreover, both portable dishwashers and traditional dishwashers typically operate by spraying a cleansing liquid such as water with detergent, onto dishes contained in a washing chamber. The spraying mechanism may be arranged to vary the spray pattern with time so that the moving liquid will contact and cleanse various areas of the dishes. For example, in one common arrangement, an arm is disposed in a horizontal plane near the bottom of the wash chamber and has orifices facing generally upwardly. While the liquid is discharged through the orifices, the arm spins around a vertical axis. A further aspect of the present invention provides an arrangement which improves the distribution of the sprayed liquid within the washing chamber of the dishwasher.

BRIEF DESCRIPTION OF THE DRAWINGS

Various embodiments of the present disclosure are described herein with reference to the following drawings in which:

FIGS. 5, 6 and 7 are fragmentary sectional views depicting portions of dishwashers according to further embodiments of the invention.

FIG. 8 is a view similar to FIG. 4 but depicting a dishwasher according to yet another embodiment of the invention.

DETAILED DESCRIPTION

As used herein, the term "front," when used in connection with the dishwasher, refers to a side of the dishwasher closest to a user, whereas the term "back" when used in connection with the dishwasher, refers to a side of the dishwasher farthest from the user. When terms of orientation, for example, "vertical" and "horizontal" or relative terms such as, "above," "upwardly," "beneath," "downwardly," and alike, are used to describe the relative position or orientation of specific features, the terms are in reference to the positions of these features in the normal gravitational frame of reference when the dishwasher is positioned in a normal operable position, with the bottom of the dishwasher resting on a surface.

A dishwasher according to one embodiment of the invention includes a housing 10 having a base 100 and a top portion 200 cooperatively forming a wash chamber 20, depicted in broken lines, inside the housing.

Figures 2, 3:
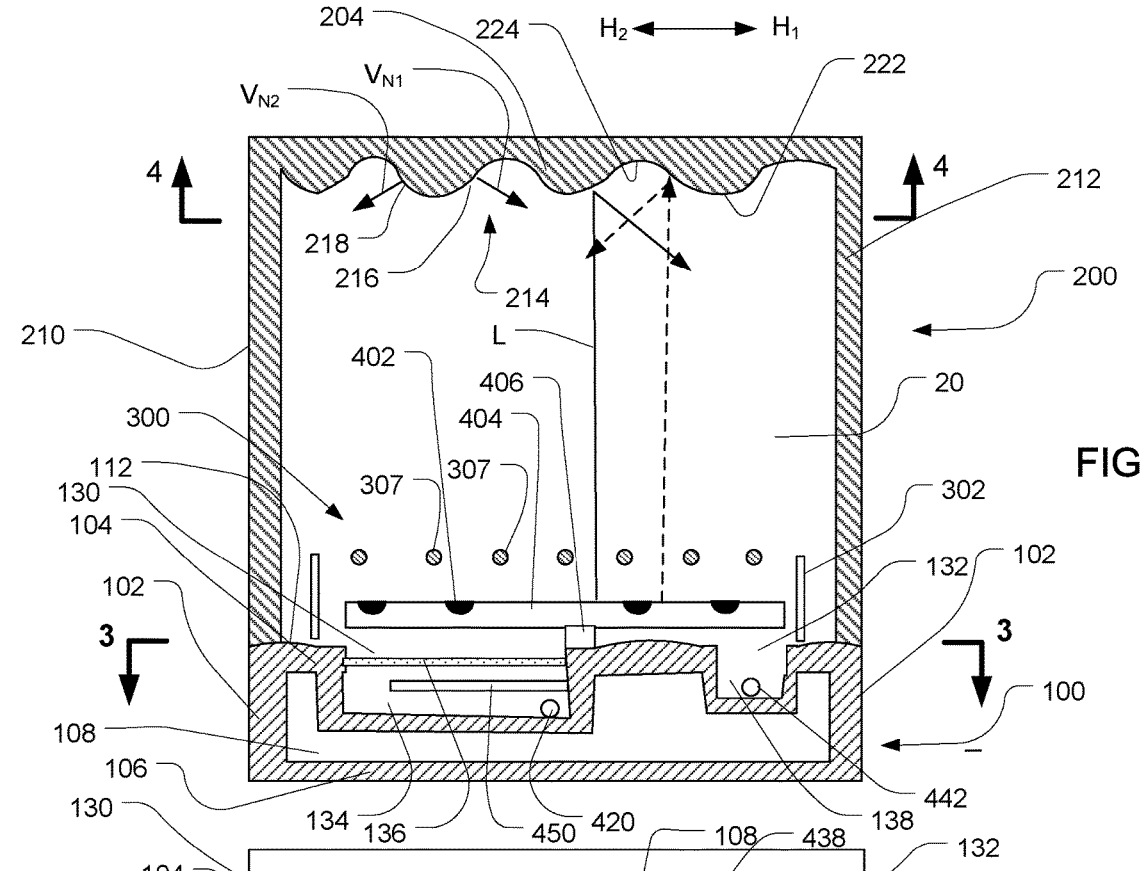
FIG. 2 is a diagrammatic sectional elevational view taken in direction 2-2 in FIG. 1.
FIG. 3 is a diagrammatic, partially sectional plan view taken in direction 3-3 in FIG. 2, with portions removed for clarity of illustration.

As best seen in FIG. 2, Base 100 includes side walls 102 extending upwardly and downwardly, an upper wall 104, and a bottom or foundation wall 106. Walls 102,104 and 106 cooperatively enclose a mechanical space 108. Foundation Wall 106 is configured to be rested upon a ground surface, for example, a countertop, a table, or a floor. Foundation wall 106 may therefore, optionally include a padding or feet (not shown) on its downwardly facing surface preventing damage to the countertop or other ground surface upon which it rests. Upwardly facing surface 112 of the top wall 104 of base 100 constitutes a floor surface 112 for wash chamber 20.

Figure 1:
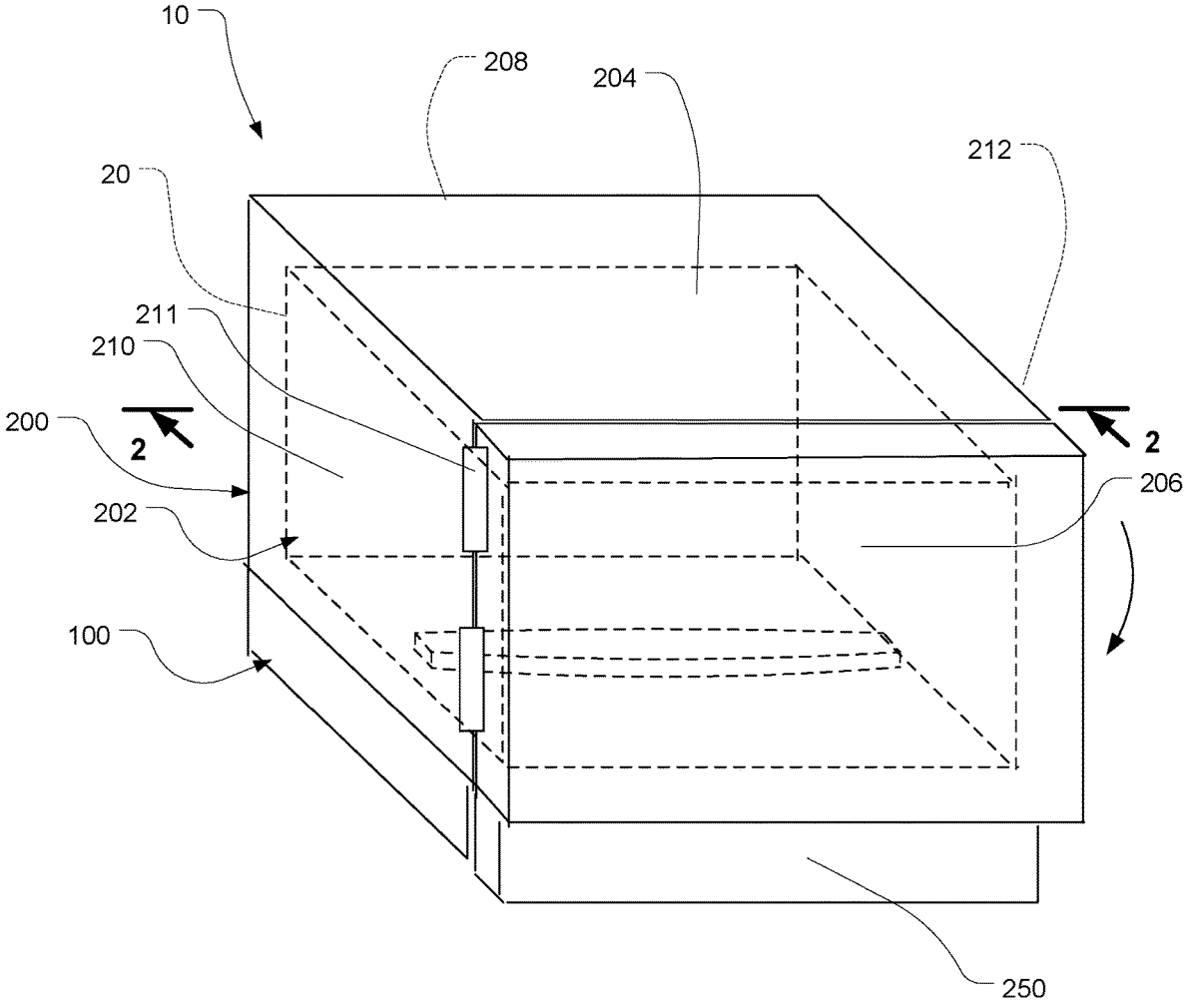
FIG. 1 is a schematic perspective view of a dishwasher in a closed configuration according to one embodiment of the present invention.

Referring to FIG. 1, the top portion 200 of the housing includes a sidewall 202 and a top panel 204. Sidewall 202 includes a rear panel 208 and opposing side panels 210, 212 fixedly connected to top panel 204 and to base 100. Sidewall 202 also includes a front panel 206 attached to side panel 210 by hinges 211. When front panel 206 is in the closed position, depicted in FIG. 1, the top portion 200 and base 100 completely enclose wash chamber 20. A seal such as a resilient gasket (not shown) is provided for sealing the front panel to the side and top panels, and to the base 100, when the front panel is in the closed position. When front panel 206 is in an open position, wash chamber 20 is accessible for loading and unloading.

Wash chamber 20 is configured to receive a rack 300 (FIG. 2). Rack 300 is adapted to receive dishes. Rack 300 has openings for passage of cleaning liquid. For example, the rack may include one or more shelves formed by spaced elements such as rods 307 upon which dishes and cutlery may rest. Support posts 302 support the shelf above the wash chamber floor 112. As used herein, unless specifically indicated otherwise, the term "dishes" includes any item used to hold, serve or prepare food or beverages for humans and pets. It thus includes items such as plates, bowls, and cups normally used to hold food and beverages at a dining table, as well as pots, pans, and other cooking and food preparation utensils as well as cutlery forks, spoons, knives, chopsticks and the like, and further include items used to prepare food or beverages for babies, such as baby bottles.

A spray system is arranged to spray a cleansing liquid L such as water or a water/detergent admixture generally upwardly within wash chamber 20. As used in this disclosure, the term "generally upwardly" refers to both an exactly vertical upward direction and to directions having both a vertical upward component and a horizontal component. Desirably, the spray system is arranged to direct the sprayed liquid upwardly from below the shelf of rack 300. In this embodiment, the spray system includes hollow arm 404 rotatably mounted to a supply pipe 406 above the floor surface 112 of the wash chamber but below the rack shelf. The hollow arm has numerous orifices distributed along its length. These orifices form a plurality of spray nozzles 402, arranged so that the liquid discharged from the orifices will be discharged in generally upwardly-directed streams. Orifices disposed on opposite sides of supply pipe 406 may be arranged to discharge streams with horizontal components of motion in opposite horizontal directions relative to the arm, so that the reaction forces produced by the discharged streams spin the arm around the axis of supply pipe 406. As further discussed below, the mechanism which supplies the cleansing liquid through the supply pipe 406 and which remove used liquid from the wash chamber desirably is housed within the mechanical space 108 defined by base 100.

The top wall 204 of top portion 200 has a surface 214 facing generally downwardly and thus facing into the wash chamber 20. As best seen in FIG. 2, the downwardly facing surface 214 is a non-planar surface which includes a plurality of non-planar features defining first surface portions 216 facing downward and facing in a first horizontal direction $H_1$ (to the right as seen in FIG. 2) and a plurality of second surface portions 218 facing downward and facing in a second horizontal direction $H_2$ (to the left as seen in FIG. 2), the second direction being different from the first direction. Stated another way, within each first surface portion, a vector $V_{N1}$ normal to the surface and pointing out of the surface has a component directed downwardly and has a component directed in the first horizontal direction $H_1$. Within each second portion, a vector $V_{N2}$ normal to the surface and pointing out of the surface has a component directed downwardly and has a non-zero component directed in the second horizontal direction $H_2$. The first and second surface portions are curved as seen in the sectional view of FIG. 2, so that they cooperatively form a smooth, wave-like pattern with the surface portions ascending to peaks 224 spaced further from the floor surface 112 and to valleys 222 spaced closer to the floor surface 112 than the peaks. The first and second surface portions are interspersed with one another in an alternating arrangement, so that they join one another at the peaks and valleys.

Figure 4:
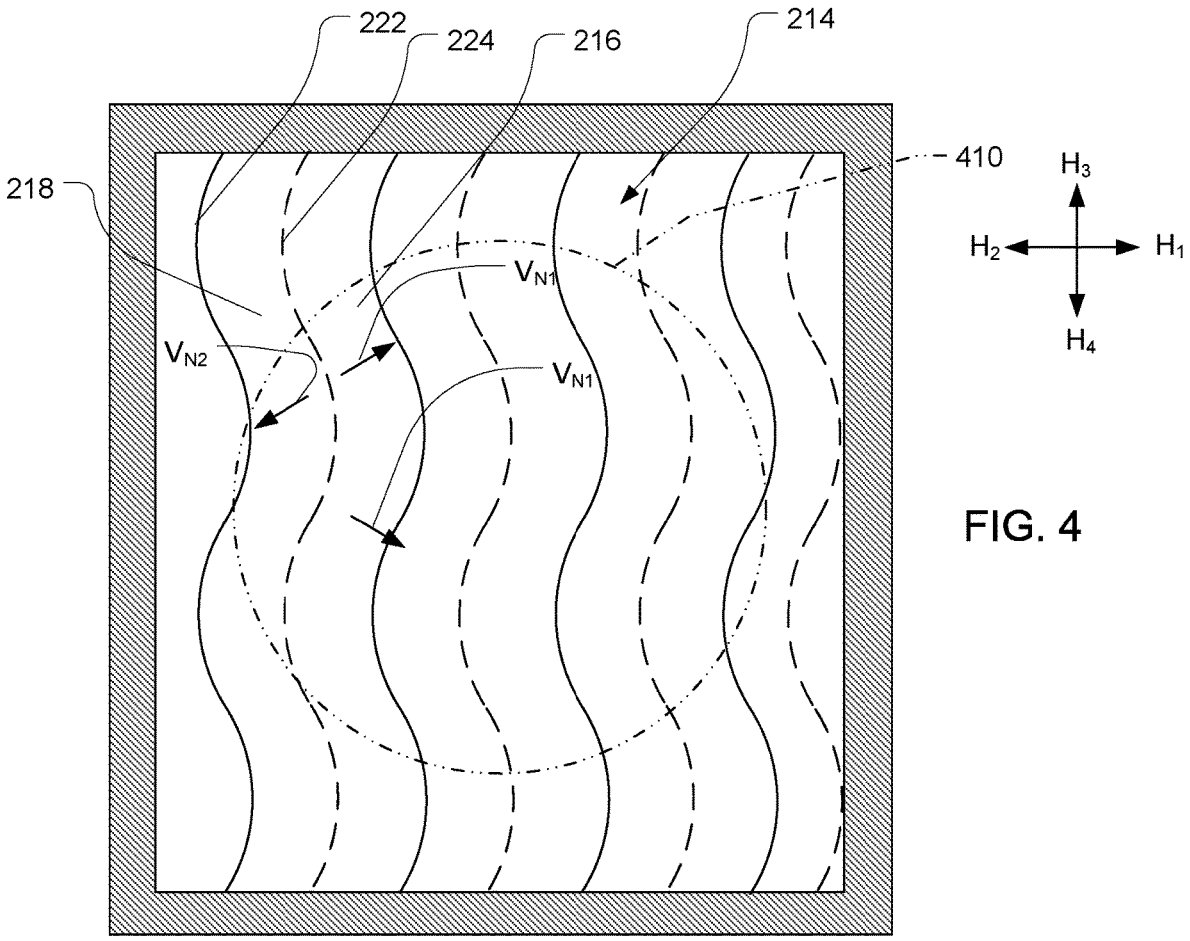
FIG. 4 is a diagrammatic sectional view taken in direction 4-4 in FIG. 2.

FIG. 4 is a diagrammatic view looking upwardly from within the wash chamber 20 towards the downwardly-facing surface 214. As seen in FIG. 4, the pattern of first and second surface portions and peaks and valleys extend over a substantial portion of the surface. In FIG. 4, each peak 224 is symbolized by a broken line, whereas each valley 222 is symbolized by a solid line. In this embodiment, the non-planar features are defining the first and second surface portions are elongated ridges defining the peaks, the valleys being interspersed between the ridges. The ridges, and thus the peaks and valleys, extend generally in a third horizontal direction $H_3$ and in an opposite, fourth horizontal direction $H_4$, both of which are orthogonal to the first and second horizontal directions $H_1$ and $H_2$. However, the ridges, and thus the peaks and valleys, as well as the first and second surface portions 216 and 218, curve in the first and second horizontal directions. Thus, the orientations of the first and second surfaces vary with position in the third and fourth horizontal directions, so that over some portions of the first and second surfaces, the normal vectors $V_{N1}$ and $V_{N2}$ have non-zero components in the third and fourth horizontal directions, as well as components in the first and second horizontal directions.

In operation, as the arm 404 (FIG. 2) spins about the vertical axis of supply pipe 406 and discharges liquid upwardly through nozzles 402, a stream of liquid L passes upwardly through rack 300. In some positions of the arm, the stream from a particular nozzle may pass through the rack and between the dishes and cutlery disposed on the rack so that the stream impinges directly on surface 214. Thus, the stream will sweep across portions of a circular path 410 (FIG. 4). As the stream sweeps along portions of the circular path, it will impinge on the first surface portions 216 and second surface portions 218 at various times. As schematically indicated in FIG. 2, when the stream L impinges on a first surface portion, as shown in solid lines, it will be redirected with a component of motion in the first horizontal direction $H_1$. When the stream impinges on a second surface portion, as shown in broken lines, it will be redirected with a component of motion in the second horizontal direction $H_2$. The redirected liquid will pass downwardly over the dishes and cutlery. The nonplanar surface thus helps to direct the liquid in various directions. A similar effect occurs when the liquid streams impinge on the dishes or cutlery and the upwardly-moving liquid is redirected by the dishes and cutlery to the non-planar surface 214. The surface 214 thus helps to assure that the liquid reaches the dishes and cutlery along many different paths. This promotes effective cleaning. Moreover, this effect can be achieved with little or no added cost.

Figure 5:
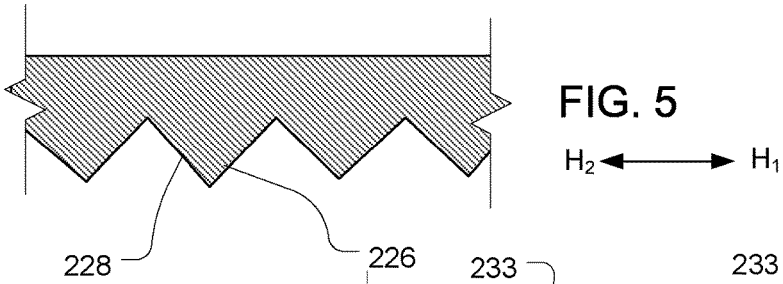
Figure 6:
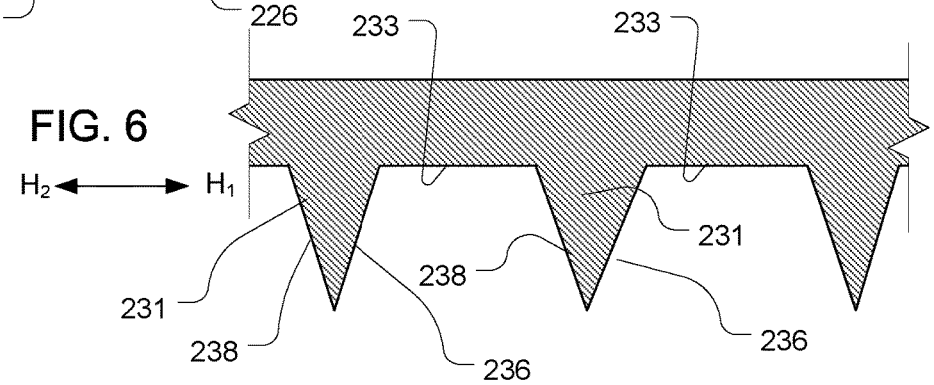

The configuration of the downwardly-facing, non-planar surface 214 can be varied from the specific configuration discussed above. For example, the vertical distance between the peaks and valleys, and hence the amplitude of the wave defined by the first and second surface portions, may vary from place to place. Likewise, the spacing of the peaks from one another in a horizontal direction, also referred to herein as the wavelength of the wave, may vary from place to place. The first and second surface portions may not necessarily be curved as seen in sectional view. For example, in the embodiment shown in FIG. 5, the first surface portions 226 and second surface portions 228 are planes facing downwardly and facing in the first and second horizontal directions, so that the first and second surface portions cooperatively form a triangular wave. The first and second surface portions need not form a continuous wave. For example, as seen in FIG. 6, the first and second surface portions 236 and 238 are defined by projections 231 which are spaced apart from one another, so that the downwardly facing surface has horizontal planar portions 233. Similarly, the first and second portions may be formed by indentations in the top wall (not shown), spaced apart from one another by horizontal planar portions.

In the embodiment discussed above with reference to FIGS. 2 and 4, first and second surfaces are substantially similar to one another but face in opposite directions, so that each peak is substantially symmetrical as seen in the sectional view of FIG. 2. However, the first and second surface portions may differ from one another in size, shape, or both.

For example, as shown in FIG. 7, the first surface portions, facing in the first horizontal direction $H_1$, are larger than the second surface portions 248. Thus, more of the upwardly-flowing liquid will impinge on the first surface portions than on the second surface portions. This will tend to redirect the liquid predominantly in the first horizontal direction.

The downwardly-facing non-planar surface may include different non-planar features in different regions of the surface. For example, the embodiment depicted in FIG. 8 is generally similar to the embodiment of FIGS. 1-4 in that it includes a housing defining a rectangular wash chamber bounded by side walls 210 and 212, front wall 206 and rear wall 208, and a rotating arm (not shown) arranged to spray water upwardly within the wash chamber. The downwardly-facing surface 214" of the top wall includes a first region 252 near one corner of the rectangular housing formed by walls 208 and 210. First region 252 has first surface portions 256 facing in a first direction $H_{1A}$ and second surface portions 258 facing in a second direction $H_{2A}$. The pattern of surface portions in this region may be arranged to direct liquid preferentially in the first direction $H_{1A}$, towards the corner formed by walls 208 and 210. A second region 254 of surface 214" is disposed near the corner formed by walls 210 and 206, and has first and second surface portions facing in horizontal directions $H_{1B}$ and $H_{2B}$ respectively. The surface portions in this region are arranged to direct liquid preferentially in direction $H_{1B}$, toward the corner of walls 206 and 210. Likewise, regions 260 and 262, adjacent the other corners, have surface portions arranged to direct liquid preferentially toward these corners.

Yet another region 264 near the center of surface 214" has surface portions arranged to provide redistribution of the liquid, without preferentially directing the liquid in one direction. The configurations discussed above with reference to FIGS. 2-6 may be used for this purpose. However, in the embodiment shown in FIG. 8, region 264 has non-planar features in the form of a series of discrete pyramidal bumps 270 projecting from the surface 214". Each bump defines four surface portions facing downwardly and facing in four different horizontal directions Hx, Hy, Hp and Hq.

In the embodiments discussed above, the non-planar, downwardly-facing surface defining the surface portions is a surface of the top wall of the housing itself. However, in other embodiments, the housing may include a separate component such as a plate in a fixed position below the top wall. In other embodiments, surfaces of the housing other than the top surface may be provided with surface portions similar to those discussed above with reference to the top portion. For example, similar surface portions may be provided on one or more surfaces facing inwardly at the sides, front or rear of the housing such as the inwardly-facing surfaces of side panel 210, side panel 212, front panel 206 and rear panel 208 (FIG. 1). These surfaces extend generally vertically. The surface portions defined by non-planar features on a vertically-extensive surface may face in opposite horizontal directions, in opposite vertical directions, or in opposite directions oblique to the horizontal and vertical directions. A vertical surface having nonplanar features defining oppositely-facing surface portions is particularly effective when used in conjunction with a spraying system (not shown) which is arranged to direct the wash liquid with a horizontal component of motion in a horizontal direction toward the vertical surface.

Desirably, the surface portions facing in horizontal directions constitute a substantial portion of the downwardly facing surface as, for example, at least 10 percent of this surface, more desirably at least 25% of this surface or at least 50% of this surface. In general, the greater the proportion of the surface constituted by the surface portions facing in horizontal directions, the more effective the surface portions will be in dispersing the liquid within the wash chamber.

In the embodiments discussed above, the housing is generally rectangular. However, the housing may have other shapes. For example, sidewall 202 may include less than four panels such that the sidewall includes, for example, three panels forming a generally triangular shape, or more than four panels such that the sidewall is pentagonal, hexagonal, octagonal or the like. In a further variant, the sidewall may be cylindrical. Also, the housing may not include a discrete top wall separate from the side wall. For example, the housing may be generally dome-shaped our pyramidal or any other shape capable of forming an enclosed wash chamber.

The dishwasher discussed above with reference to FIGS. 1-4 is a portable dishwasher which can be positioned on any suitable supporting surface and operated without a connection to plumbing or drainage. The mechanism which supplies cleaning solution to the supply pipe 406 of the spraying system (FIG. 2) and which drains used cleaning solution from the wash chamber 20 is disposed in the mechanical space 108 within base 100, so that the mechanism is disposed beneath floor surface 112 of the wash chamber.

In FIG. 3, portions of the upper wall 104 of the base are removed for clarity of illustration. In practice, the upper wall 104 and the floor surface 112 defined by the upper wall, extend over the entire base. As seen in FIGS. 2 and 3, the upper wall of the base defines a first drain opening 130 and a second drain opening 132 separate from the first drain opening. The floor surface desirably is inclined slightly so that it slopes downwardly toward these drain openings. A first sump 134, (FIG. 2) referred to herein as the "operational" sump, extends downwardly from the first drain opening 130 and communicates with the wash chamber through the first drain opening. A filter is 136 is removably mounted in the operational sump 130. A second sump 138, referred to herein as the "collector" sump, extends downwardly from the second drain opening 132 and communicates with the wash chamber through the second drain opening. The operational sump 134 desirably has a substantial volume as, for example, about 0.3 to 0.5 US gallons (1.1 to 1.9 liters). The collector sump 138 desirably is smaller than the operational sump 134, and is shallower than the operational sump.

A pump 412 having an inlet 414 and an outlet 416 is mounted within the mechanical space 108. For example, pump 412 may be a centrifugal pump. The inlet 414 of the pump is connected to the operational sump 134 by an inlet conduit 418 communicating with the operational sump through an operational port 420 near the bottom of the sump. The outlet 416 of the pump is connected to the supply pipe 406 and thus connected to the spraying arm 404.

A fresh water reservoir 422 is permanently mounted within mechanical space 108. The fresh water reservoir is arranged to hold enough water to complete a full wash cycle as discussed below. For example, for a portable dishwasher intended to wash two normal place settings or an equivalent amount of other items, the fresh water reservoir may be arranged to contain and supply about 1 to 1.3 US gallons (3.8 to 4.9 liters). As used in this disclosure, a statement that a reservoir is "permanently" mounted means that the reservoir is mounted so that it need not be removed during the course of normal operations of the dishwasher. Typically, a permanently mounted reservoir is concealed within the base by fixed walls of the base, so that the reservoir cannot be removed without disassembling the base, and is physically connected to the other elements of the structure so that it cannot be detached without the use of tools.

Figure 9:
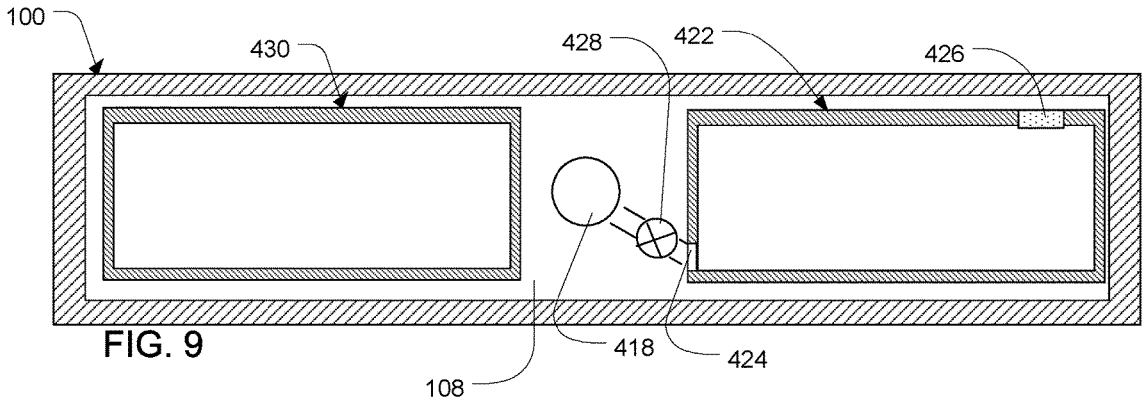
FIG. 9 is a diagrammatic sectional view taken in direction 9-9 in FIG. 3.

As best seen in FIG. 9, the fresh water reservoir 422 has an opening 424 communicating with the interior of the reservoir near the bottom of the reservoir. The fresh water reservoir also has a vent opening 426 communicating with the interior of the reservoir at or near the top of the reservoir. The vent opening desirably is filled or covered by a porous, hydrophobic element arranged to allow passage of air but to block passage of water. The opening 424 of the reservoir is connected to the inlet conduit 418 through a fresh water valve 428, which desirably is an electrically-controlled valve such as a solenoid-actuated valve. Thus, when the fresh water valve 428 is open, the lower part of the fresh water reservoir communicates with the pump inlet 414 (FIG. 3) and with the operational sump 134, and the fresh water reservoir is isolated from these components when the fresh water valve is closed.

A used water reservoir 430 is removably mounted within the mechanical space 108 of the base. As used herein, the statement that a reservoir is "removably" mounted means that the reservoir can be readily removed by an ordinary user in normal operation of the dishwasher, most preferably without the use of tools. The base has an opening 150 in the vertical wall 102 at the front of the base. A skirt 250 is mounted to the bottom of front panel 206 of the upper housing portion 200 (FIG. 1), so that when panel 206 is in the closed position depicted in FIG. 1, the skirt covers opening 150. However, when panel 206 is open, the opening 150 is uncovered, so that the user can grasp the used water reservoir and pull it out of the housing. The used water reservoir may be provided with a handle (not shown) to facilitate this process. One or more readily-releasable catches or detents (not shown) may be provided to hold the used water reservoir in place within the base.

The used water reservoir desirably has a volume at least equal to the volume of the fresh water reservoir. The used water reservoir has an inlet opening 432, which is desirably disposed near the top of the reservoir. A closure, schematically shown as a ball 434 mounted to a spring 436, is biased toward inlet opening 432, and is arranged so that the closure will seat in the opening and close the opening. The used water reservoir also has an outlet opening 437, which is normally closed by a removable cap 438.

A used water conduit 440 communicates with the collector sump 132 via a used water port 442 (FIG. 2) near the bottom of the collector sump. The used water port 442 desirably is disposed at a level higher than the operational port 420. A used water valve 444 is arranged to allow flow through conduit 440 when the valve is open and to block flow when the valve is closed. The used water conduit is arranged to form a liquid-tight connection with the inlet opening 432 of reservoir 430 when the reservoir is in place in the base. In this embodiment, the end of the conduit is arranged to enter into the opening 432, and has an O-ring or other resilient seal to engage the wall of the conduit. The end of the conduit forces the closure 434 away from the opening 432, so that the closure does not block the opening. The conduit end may have a castellated configuration so that the closure will not block the conduit. Thus, when the used water reservoir is in place as shown, the used water reservoir is in communication with conduit 440 and, when valve 444 is open, in communication with collector sump 132.

The mechanism also includes a heater. The heater may be a conventional resistance heater 450 disposed in the operational sump 134, or may be an ohmic heater arranged to heat water flowing through it by directing an electrical current through the water. Such a heater may be mounted in the inlet conduit 418. A thermostat (not shown) may be provided for measuring the temperature of water circulating though the inlet conduit or pump. Also, the mechanism may include water level sensors (not shown) arranged to detect the water levels in the fresh water reservoir and in the used water reservoir as, for example, such as capacitive sensors or sensors which detect the weight of each reservoir. The heater mechanism includes a power supply connection (not shown), which may be equipped with a plug for connection to a conventional household electric power outlet. For example, for use in the United States, the plug may be arranged for connection to a conventional 110 volt, 15 ampere outlet. The mechanism further includes a control circuit (not shown) which is arranged to perform the operations discussed below. The control circuit may include elements such as a programmable logic controller and appropriate drivers for directing power from the power supply connection to the pump, the heater and the valves to actuate these elements. Although the components of the mechanism are depicted with substantial spaces between them in FIGS. 2, 3 and 9 for clarity of illustration, in practice it is desirable to pack the components tightly within the mechanical space 108 of the base, so as to provide large the fresh water and used water reservoirs in a base of a given size.

At the beginning of operation, the control system opens the fresh water valve 428 and closes the used water valve 440. With the front panel 206 open, the user loads dishes, cutlery or other utensils into the wash chamber 20, and pours water into the wash chamber 20. The water passes into the operational sump 134. Some of the water will flow into the pump, thus priming the pump, and some of the water will remain in the operational sump, but most of the water will flow into the fresh water reservoir 422. After filling the fresh water reservoir in this manner, the user places detergent in the wash chamber and closes the front panel. The control system actuates the pump to draw water from the fresh water reservoir and circulate the water through the spray system into the wash chamber, where the water mixes with the detergent to form a wash solution. When the pump has drawn a predetermined amount of water from the reservoir, as indicated by the level sensor, the control system closes the fresh water valve 440 but maintains the pump in operation to circulate the wash solution through the wash chamber, where it drains into the operational sump and passes back through the pump and wash chamber. While the wash solution is circulating, the pump actuates the heater at a relatively high power level to heat the wash solution. In this phase of operation, the control system desirably operates the pump at a relatively low power level, so that the total power drawn from the power supply by the pump and heater does not exceed the power available from the household circuit. Once the circulating wash solution has reached a preset wash temperature, the control system reduces power to the heater and increases power to the pump, so as to provide a vigorous spray of wash solution within the wash chamber. As discussed above, the wash solution is dispersed within the wash chamber and effectively contacts the dishes. During circulation of the wash solution, the solution may drain back into the operational reservoir 134 in an intermittent manner. The relatively large volume of the operational sump maintains a constant supply of wash solution to the pump, so that the pump does not run dry and lose prime. The filter in the operational sump will catch large particles and prevent them from clogging or damaging the valves or pump.

After a suitable wash interval, the control system opens used water valve 440 so that the wash solution, drains through the collector sump 138 and into the used water reservoir. The pump may be maintained in operation while the wash solution is draining, so that wash solution which enters the operational reservoir is pumped back into the wash chamber and at least some of this solution drains into the collector sump. As this phase of operation continues, the amount of wash solution draining back into the collector sump decreases, so that continued operation of the pump draws down the level of wash solution in the collector sump, until this level ultimately reaches the port 420 in the operational sump. At this point, only a small amount of the wash solution remains in the operational reservoir 134, in the inlet conduit and in the pump. To rinse the dishes, the control system closes the used water valve 440, opens the fresh water valve 428, and restarts the pump to draw fresh water from the fresh water reservoir 422 until the fresh water reservoir is almost empty, and then closes the fresh water valve 428. Because the volume of wash solution retained in the operational reservoir at the beginning of the rinse cycle is small in comparison to the volume of fresh water introduced in the rinse cycle, mixing of the retained wash solution with the rinse water does not significantly impede the rinse cycle. The pump continues to circulate the fresh water through the wash chamber for a period sufficient to rinse the dishes, and then the control system opens the used water valve 444 so that the used rinse water drains into the used water container. Here again, the pump continues in operation to draw the used rinse water from the operational sump and pump it up into the wash chamber where it drains into the collector sump and into the used water reservoir 430. Because the used water port is disposed at a relatively high level, the used rinse water will continue to drain by gravity into the used water reservoir 430 even when the used water reservoir is almost full. Stated another way, the separate collector sump with a relatively high used water port 442 allows effective use of the upper portion of the interior volume of the used water reservoir. After the rinse water has drained, the user can open front panel 206, remove the washed and rinsed dishes, and remove the used water reservoir 430 from the dishwasher. Closure 434 will automatically block the inlet opening 432, so that used water will not spill out of the used water reservoir. The user can carry the used water reservoir to a sink or drain, remove cap 438, and empty the used water from the reservoir.

In a variant of the sequence of operations discussed above, two or more sequential rinse operations can be employed. Thus, the control circuit can actuate the fresh water valve to provide a first portion of the rinse water in a first rinse operation, followed by actuation of the used water valve to drain the first portion of the rinse water which has mixed with the retained wash solution, followed by a further rinse cycle using the remaining fresh water from the reservoir.

Because the dishwasher does not require a drainage hose, it can be operated at a location remote from any sink or drain. This makes the dishwasher particularly well-suited to use in dwellings or vehicles where space near the sink limited. Moreover, the user does not need to touch or see the used water. The user can use any utensil, such as a water pitcher, to convey clean water to the dishwasher.

In the embodiment discussed above with reference to FIGS. 2, 3 and 9, the fresh water reservoir 422 and used water reservoir 430 are connected to separate sumps. In a variant schematically depicted in FIG. 10, both of the reservoirs are connected to the operational sump 134' via pump inlet conduit 418' and the port 420' near the bottom of the operational sump 134'. Thus, the fresh water inlet valve 428' is connected between the fresh water reservoir 422' and the pump inlet conduit, whereas the used water valve 440' is connected between the used water reservoir 430' and the conduit. In a further variant, the used water reservoir can be connected via the used water valve to a separate port near the bottom of the operational sump. In either of these variants, the collector sump 138 and the associated drain opening 132 used in the embodiment of FIGS. 2, 3 and 9 are omitted. These features can be used with the fresh water reservoir and used water reservoir disposed side-by-side, as shown in FIGS. 2 and 3. Desirably, at least a portion of the interior volume of the used water reservoir sufficient to hold the wash solution from the wash portion of the cycle lies below the port of the operational sump connected to the used water reservoir. This allows substantially complete drainage of the operational sump prior to the rinse cycle, and may also drain the pump and inlet conduit. When the fresh water valve is opened, the operational sump is refilled, and the pump is re-primed.

Figure 10:
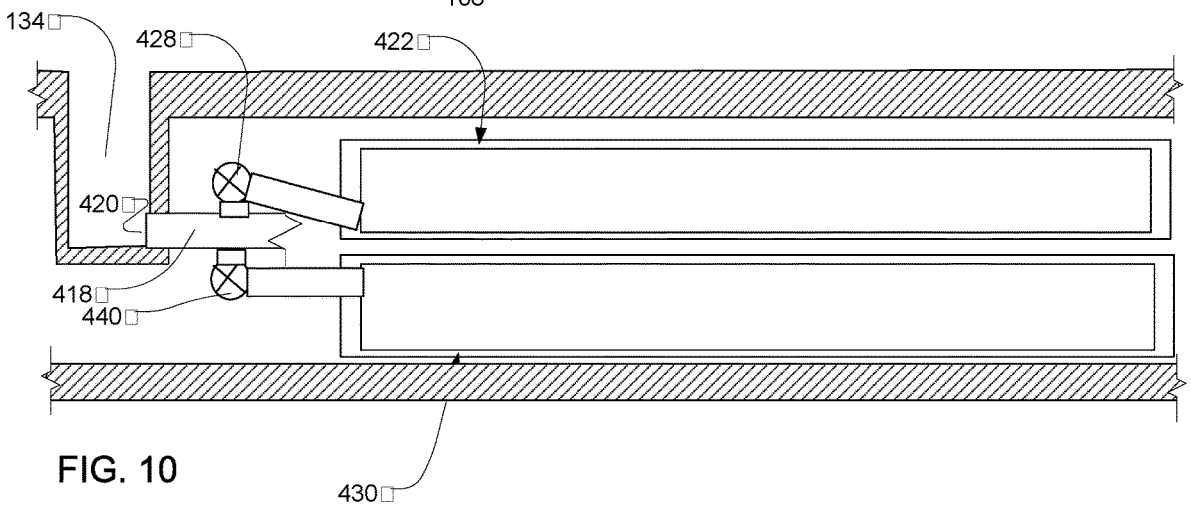
FIG. 10 is a fragmentary, diagrammatic sectional view depicting portions of a dishwasher according to yet another embodiment of the invention.

In the embodiment of FIG. 10, the volume of the used water reservoir 430' which is disposed below the level of the port 420' in the sump used to drain the used water is equal to or greater than the usable volume of the fresh water reservoir, so that used rinse water can be drained from the operational sump at the end of the rinse cycle. Desirably, all or substantially all of the interior volume of the fresh water reservoir 422' is disposed above the level of the port 420' which connects the fresh water reservoir with the operational sump. This further assures that the operational reservoir can be refilled, and the pump can be re-primed, at any stage of the operation. In the embodiment of FIG. 10, the fresh water reservoir 422' is disposed above the used water reservoir 430'. In this arrangement, the reservoirs may partially or completely overlap one another.

In the embodiments discussed above, the spraying system includes a rotating arm. However, the features discussed above can be applied in dishwashers which use other spraying elements as, for example, fixed nozzles having a fixed or time-varying spray pattern and nozzles mounted on movable elements other than rotating arms.

Figure 11:
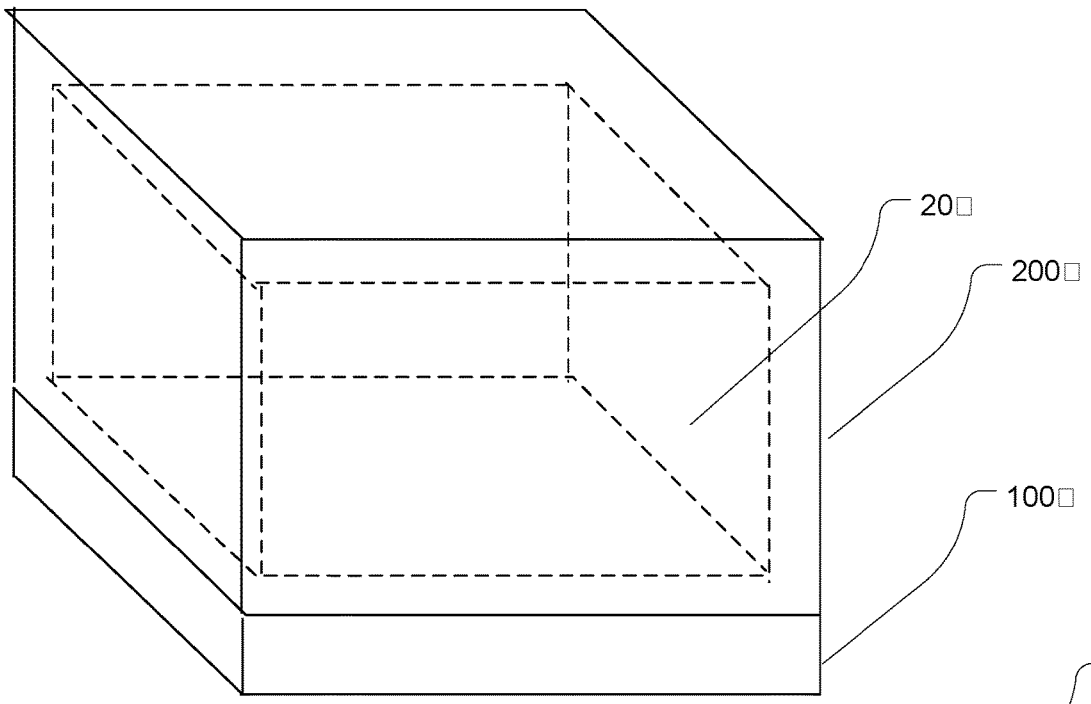
FIG. 11 is a view similar to FIG. 1 but depicting a dishwasher according to a still further embodiment of the invention.

In a further variant, the top portion of the housing may be detachable from the base. In the embodiment of FIG. 11, the top portion 200' is formed as a unitary hollow body with all of the vertical panels fixed to the top panel. Here again, the top portion has no bottom panel. In the closed position depicted, the top portion is disposed atop the base 100'. The top portion 200' is readily removable from the base, so that the user can gain access to the base to load dishes on the rack (not shown) and pour fresh water into the operational sump (not shown).

Figure 12:
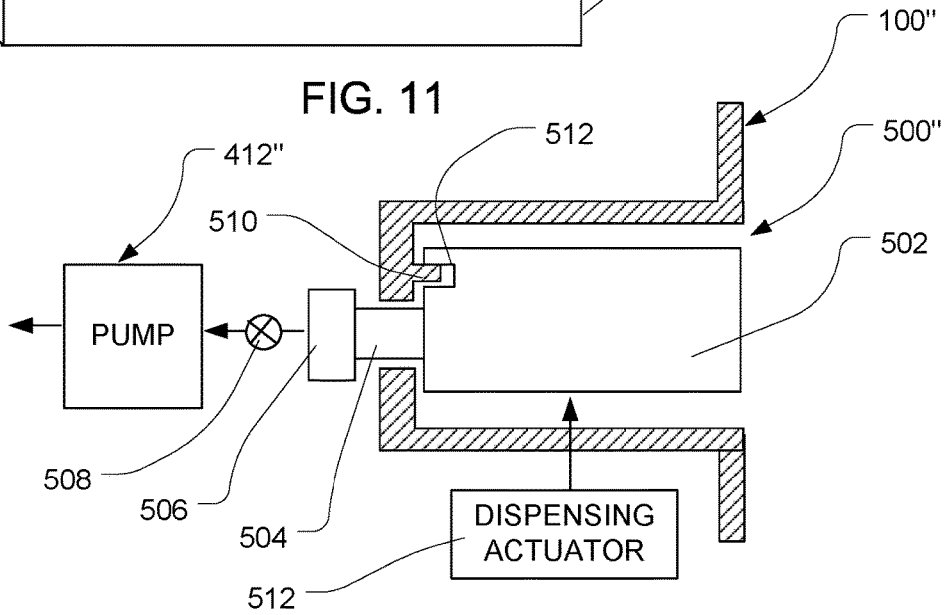
FIG. 12 is a fragmentary, diagrammatic, partially sectional view depicting a portion of a dishwasher according to another embodiment of the invention.

According to yet another aspect of the invention, a portable dishwasher is provided with a removable and replaceable pre-filled detergent cartridge. Thus, as shown in FIG. 12, the base 100" of the housing may be provided with a socket 500 which is adapted to engage a cartridge 502. Cartridge 503 desirably contains a sufficient amount of detergent for a plurality of wash cycles. For example, the detergent may be in a liquid form. The cartridge is provided with an outlet fitting 504. The mechanism of the dishwasher includes a detergent inlet fitting 506, which is in communication with the inlet of the pump 412" through a detergent dispensing valve 508 linked to the control system (not shown) of the dishwasher. Socket 500 is arranged so that when the cartridge is inserted in the socket, the outlet fitting 504 is in communication with detergent inlet fitting 506 and the two fittings desirably form a sealed connection.

The socket 500" desirably has features such as one or more projections 510 and the cartridge 502 has features such as one or more recesses 512 adapted to mate with the features of the socket. The mating features are arranged to assure that only a cartridge with the mating features 512 can be inserted into the socket to establish communication with the detergent inlet fitting 506. The mating features may be provided on fittings 504 and 506 instead of, or in addition to, the depicted arrangement. Also, the mating features may include elements such as splines, keyways, threaded elements, bayonet locking elements and other mechanical features. In a further variant, the cartridge may be provided with one or more features that can be detected a sensor such as an electrical, magnetic or optical sensor linked to the control system of the dishwasher, and the control system may be arranged to leave the detergent dispensing valve 508 closed unless the correct features are detected. In other respects, the dishwasher of FIG. 12 may be the same as those discussed above.

During operation of the dishwasher, the control system actuates the detergent dispensing valve 508 during the wash cycle, so that detergent is drawn from the cartridge 502 and mixes with water circulating through pump 412" to form a wash solution, and the wash solution passes into the wash chamber of the dishwasher through the spraying system. The amount of detergent drawn from the cartridge may be controlled by controlling the duration of opening of the detergent dispensing valve. The control system may be arranged to signal the user to replace the cartridge, as by actuating a warning light (not shown), when the cartridge in the socket has been used for a predetermined number of cycles. Alternatively or additionally, the control system may be arranged to send a signal via a communications network (not shown) as, for example, via the internet, to a supplier so that the supplier can dispatch a replacement cartridge to the user of the dishwasher pursuant to a subscription agreement between the user and the supplier.

The mechanism of the dishwasher may include a dispensing actuator, schematically shown at 512, arranged to forcibly expel the detergent from the cartridge 502. For example, where the cartridge includes a movable element such as a piston (not shown), the dispensing actuator may include a ram linked to a motor (not shown) for advancing the piston within the cartridge. Where the cartridge is collapsible or partially collapsible, the dispensing actuator may be arranged to squeeze the cartridge. Where a dispensing actuator is employed, the control system may be arranged to control the amount of detergent expelled from the cartridge by controlling the action of the dispensing actuator.

In a further variant, the detergent dispensing valve may be connected to the wash chamber (not shown) rather than to the inlet of the pump, so that detergent dispensed from the cartridge mixes with water in the wash chamber itself.

In yet another variant, the detergent may be in powder form. The dispensing actuator may include a mechanism such as a piston or screw for expelling a predetermined amount of the powder from the cartridge.

In a further variant, the fresh water reservoir can be removably mounted in the housing and may be arranged so that the user can fill the fresh water reservoir before inserting it into the housing. The fresh water reservoir may be equipped with features similar to the features discussed above with reference to the use water reservoir 430 (FIG. 3). For example, the fresh water valve may have an opening adapted to releasably mate with the fresh water inlet valve 428 in a sealing manner, and may have a closure similar to closure 434 (FIG. 3) arranged to seal the opening when the fresh water reservoir is removed from the housing. In this arrangement, the fresh water reservoir may have a separate filling opening with a removable cap to allow the user to fill the fresh water reservoir from a sink or other source.

In yet another variant, the dishwasher may incorporate a drain hose in lieu of the used water reservoir or in addition to the used water reservoir. For example, a drain hose may be coupled to the used water valve in place of the removable used water reservoir in any of the embodiments discussed above if the user wishes to place the dishwasher near a sink. In another example, the dishwasher can be provided with a connection for a drain hose in lieu of a connection for a removable used water reservoir.

Although the features of the invention have been described above with reference to portable dishwashers, features discussed above also can be applied in traditional dishwashers which are fixed in place and permanently connected to the plumbing and drainage systems of a building. Merely by way of example, a housing having a surface facing downwardly toward the wash chamber, with portions of this surface facing in opposite horizontal directions as discussed above with reference to FIG. 2 and FIGS. 4-8 can be applied in a fixed dishwasher.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A portable dishwasher comprising:

(a) a housing including a base partially defining a wash chamber having a floor and a mechanical space beneath the floor, the floor having one or more drain openings;

(b) an operational sump extending downwardly from the floor into the mechanical space communicating with the wash chamber through one of said drain openings;

(c) a pump having an inlet communicating with the operational sump and an outlet communicating with the wash chamber; and (d) a used water reservoir disposed within the mechanical space and communicating with the wash chamber through one of said drain openings via a used water conduit so as to receive used wash solution from the wash chamber, the used water reservoir being removable from the housing so that the used wash solution received by the used water reservoir can be emptied;

wherein the used water reservoir includes an inlet adapted for connection to the used water conduit and a closure arranged to block the inlet, the inlet being disposed in an upper region of the used water reservoir, and the closure being mounted to the used water reservoir so as to move with the used water reservoir when the used water reservoir is removed from the housing, the closure being biased to automatically block the inlet when the used water reservoir is removed from the housing.

2. A dishwasher as claimed in claim 1, wherein the floor of the housing has at least two drain openings separate from one another, the operational sump communicating with the wash chamber through a first one of the drain openings, the used water reservoir communicating with the wash chamber through a second one of the drain openings.

3. A dishwasher as claimed in claim 2 wherein the housing includes a collector sump separate from the operational sump, the collector sump extending downwardly from the floor and communicating with the wash chamber through the second one of the drain openings, the used water reservoir communicating with the collector sump through the used water conduit so that the used water reservoir communicates with the wash chamber through the used water conduit and the collector sump.

4. A dishwasher as claimed in claim 3, wherein the used water reservoir and used water conduit communicate with the collector sump through a used water port in the collector sump, and wherein the pump inlet communicates with the operational sump through an operational port in the operational sump, the used water port being disposed at a higher level than the operational port.

5. A dishwasher as claimed in claim 4, further comprising a control system operative to drain water from the operational sump by actuating the pump to pump water from the operational sump while maintaining the used water conduit open, so that water from the operational sump passes through the wash chamber and drains into the used water reservoir.

6. A dishwasher as claimed in claim 1, further including a fresh water reservoir disposed within the mechanical space, wherein a lower part of the fresh water reservoir communicates with the pump inlet.

7. A dishwasher as claimed in claim 1, wherein at least a part of an interior volume of the used water reservoir is disposed at a level above a level of the pump inlet.

8. A dishwasher as claimed in claim 1, further including a fresh water reservoir disposed within the mechanical space, wherein at least a part of an interior volume of the used water reservoir is disposed at a level below a level of a lowest part of an interior volume of the fresh water reservoir.

9. A dishwasher as claimed in claim 8, wherein at least a part of the used water reservoir is disposed beneath the fresh water reservoir.

10. A dishwasher as claimed in claim 1, wherein the used water conduit is connected between the operational sump and the used water reservoir, so that the used water reservoir communicates with the wash chamber through the used water conduit and the operational sump.

11. A dishwasher as claimed in claim 10 further comprising a cartridge containing detergent in a quantity sufficient for a plurality of wash cycles, the cartridge being removably mounted to the base and communicating with the pump inlet or the wash chamber.

12. The dishwasher of claim 10 further comprising a detergent dispensing valve connected between the cartridge and the pump inlet or wash chamber for controlling release of detergent from the cartridge.

13. The dishwasher of claim 10 wherein the cartridge has a predetermined configuration, the dishwasher including one or more features mounted to the base and adapted to prevent connection or use of a cartridge having a configuration different from the predetermined configuration.

14. A portable dishwasher comprising:

(a) a housing including a base partially defining a wash chamber having a floor and a mechanical space beneath the floor, the floor having one or more drain openings;

(b) an operational sump extending downwardly from the floor into the mechanical space communicating with the wash chamber through one of said drain openings;

(c) a pump having an inlet communicating with the operational sump and an outlet communicating with the wash chamber;

(d) a fresh water reservoir disposed within the mechanical space beneath the floor, the fresh water reservoir being in communication with the inlet of the pump so as to supply fresh water to the outlet communicating with the wash chamber; and (e) a used water reservoir separate from the fresh water reservoir, the used water reservoir being disposed within the mechanical space and communicating with the wash chamber through one of said drain openings via a used water conduit so as to receive used wash solution from the wash chamber;

wherein the fresh water reservoir is permanently mounted to the housing and the used water reservoir is removable from the housing; and wherein an opening of the fresh water reservoir communicates with the wash chamber such that the fresh water reservoir is fillable via the opening by a user pouring water directly into the wash chamber.

15. A dishwasher as claimed in claim 14, wherein the used water reservoir includes an inlet adapted for connection to the used water conduit and a closure arranged to block the inlet upon removal of the used water reservoir from the housing.

16. A dishwasher as claimed in claim 15, wherein the closure is mounted to the used water reservoir so as to move with the used water reservoir when the used water reservoir is removed from the housing, and the closure is biased to automatically block the inlet when the used water reservoir is removed from the housing.

17. A dishwasher as claimed in claim 14, wherein the floor of the housing has at least two drain openings separate from one another, the operational sump communicating with the wash chamber through a first one of the drain openings, the used water reservoir communicating with the wash chamber through a second one of the drain openings.

18. A dishwasher as claimed in claim 17 wherein the housing includes a collector sump separate from the operational sump, the collector sump extending downwardly from the floor and communicating with the wash chamber through the second one of the drain openings, the used water reservoir communicating with the collector sump through the used water conduit so that the used water reservoir communicates with the wash chamber through the used water conduit and the collector sump.

19. A dishwasher as claimed in claim 18, wherein the used water reservoir and used water conduit communicate with the collector sump through a used water port in the collector sump, and wherein the pump inlet communicates with the operational sump through an operational port in the operational sump, the used water port being disposed at a higher level than the operational port.

20. A dishwasher as claimed in claim 19, further comprising a control system operative to drain water from the operational sump by actuating the pump to pump water from the operational sump while maintaining the used water conduit open, so that water from the operational sump passes through the wash chamber and drains into the used water reservoir.

21. A dishwasher as claimed in claim 14, wherein a lower part of the fresh water reservoir communicates with the pump inlet.

22. A dishwasher as claimed in claim 14, wherein at least a part of an interior volume of the used water reservoir is disposed at a level above a level of the pump inlet.

23. A dishwasher as claimed in claim 14, wherein at least a part of an interior volume of the used water reservoir is disposed at a level below a level of a lowest part of an interior volume of the fresh water reservoir.

24. A dishwasher as claimed in claim 23, wherein at least a part of the used water reservoir is disposed beneath the fresh water reservoir.

25. A dishwasher as claimed in claim 14, wherein the used water conduit is connected between the operational sump and the used water reservoir, so that the used water reservoir communicates with the wash chamber through the used water conduit and the operational sump.

26. A dishwasher as claimed in claim 25 further comprising a cartridge containing detergent in a quantity sufficient for a plurality of wash cycles, the cartridge being removably mounted to the base and communicating with the pump inlet or the wash chamber.

27. The dishwasher of claim 25 further comprising a detergent dispensing valve connected between the cartridge and the pump inlet or wash chamber for controlling release of detergent from the cartridge.

28. The dishwasher of claim 25 wherein the cartridge has a predetermined configuration, the dishwasher including one or more features mounted to the base and adapted to prevent connection or use of a cartridge having a configuration different from the predetermined configuration.

* * * * *